US008840971B2

(12) United States Patent
Meersseman et al.

(10) Patent No.: US 8,840,971 B2
(45) Date of Patent: Sep. 23, 2014

(54) METHOD FOR MANUFACTURING PANELS AND PANELS OBTAINED THEREBY

(75) Inventors: Laurent Meersseman, Kortrijk (BE); Christophe Maesen, Lichtervelde (BE)

(73) Assignee: Flooring Industries Limited, SARL, Bertrange (LU)

( * ) Notice: Subject to any disclaimer, the term of this patent is extended or adjusted under 35 U.S.C. 154(b) by 169 days.

(21) Appl. No.: 13/163,259

(22) Filed: Jun. 17, 2011

(65) Prior Publication Data

US 2011/0318507 A1 Dec. 29, 2011

(30) Foreign Application Priority Data

Jun. 23, 2010 (BE) ..... 2010/0371

(51) Int. Cl.

| | |
|---|---|
| ***B05D 3/00*** | (2006.01) |
| ***B05D 3/06*** | (2006.01) |
| ***B44B 5/02*** | (2006.01) |
| ***B44C 1/22*** | (2006.01) |
| ***B44C 5/04*** | (2006.01) |

(52) U.S. Cl.

CPC . *B44C 5/04* (2013.01); *B44B 5/026* (2013.01); *B44C 1/22* (2013.01)

USPC ..... 427/555; 427/553; 427/595; 427/510

(58) Field of Classification Search

CPC ..... B05D 3/06; B05D 3/061; B05D 3/065; B05D 3/067; B44C 1/22; B44C 1/228

USPC ..... 427/510, 512, 553, 555, 466

See application file for complete search history.

(56) References Cited

U.S. PATENT DOCUMENTS

| | | | | |
|---|---|---|---|---|
| 1,971,067 | A | 8/1934 | Fess | |
| 3,173,804 | A | 3/1965 | Standfuss | |
| 3,554,827 | A | 1/1971 | Yamagishi | |
| 3,811,915 | A | 5/1974 | Burrell et al. | |
| 5,317,080 | A * | 5/1994 | Arimatsu et al. | 528/332 |
| 6,200,646 | B1 * | 3/2001 | Neckers et al. | 427/510 |
| 6,633,019 | B1 | 10/2003 | Gray | |
| 6,874,894 | B2 | 4/2005 | Kitamura | |
| 6,888,147 | B1 * | 5/2005 | Hansson et al. | 250/453.11 |
| 2002/0085133 | A1 | 7/2002 | Ho et al. | |
| 2002/0135857 | A1 | 9/2002 | Fitzpatrick et al. | |
| 2004/0026017 | A1 | 2/2004 | Taylor et al. | |
| 2006/0066924 | A1 | 3/2006 | Delueg | |

FOREIGN PATENT DOCUMENTS

| | | | |
|---|---|---|---|
| DE | 19532819 | A1 | 3/1997 |
| DE | 102005046264 | A1 | 4/2007 |
| DE | 202008008597 | U1 | 9/2008 |
| EP | 1746823 | A1 | 1/2007 |
| EP | 1872959 | A1 | 1/2008 |
| EP | 2123476 | A2 | 11/2009 |
| JP | 56060250 | A | 5/1981 |
| WO | 9747834 | A1 | 12/1997 |
| WO | 0147724 | A1 | 7/2001 |
| WO | 0147725 | A1 | 7/2001 |
| WO | 0148333 | A1 | 7/2001 |
| WO | 2004042168 | A1 | 5/2004 |

* cited by examiner

*Primary Examiner* — Dah-Wei D Yuan
*Assistant Examiner* — Nga Leung V Law
(74) *Attorney, Agent, or Firm* — Capitol City TechLaw

(57) ABSTRACT

A method for manufacturing coated panels of the type including at least a substrate and a top layer, provided on the substrate, with a motif, may involve providing a synthetic material layer on the substrate, and providing a relief on the surface of the synthetic material layer. The relief may show a pattern of recesses and/or protrusions. The pattern may be at least partially determined using a light-projection technique.

9 Claims, No Drawings

METHOD FOR MANUFACTURING PANELS AND PANELS OBTAINED THEREBY

PRIORITY STATEMENT

This U.S. non-provisional application claims priority under 35 USC §119 to Belgian Patent Application No. 2010/0371 filed Jun. 23, 2010, the content of which is incorporated herein in its entirety by reference.

BACKGROUND

1. Field of the Invention

This invention relates to a method for manufacturing panels as well as to panels which can be obtained by such method.

More particularly, the invention relates to methods for manufacturing panels of the type which comprises at least a substrate and a top layer, provided on this substrate, with a motif. Herein, this may relate, for example, to furniture panels, ceiling panels, floor panels or the like, which substantially consist of an MDF or HDF (Medium or High Density Fiberboard) basic panel or substrate and a top layer provided thereon. In particular, it relates to a method wherein one or more material layers are provided on the substrate, wherein at least one of these material layers comprises a printed substrate. Preferably, this herein relates to a motif which is at least partially obtained by means of a print performed directly on the substrate. However, the invention also applies for panels wherein the motif thereof is realized in another manner, for example, by printing said motif on a carrier sheet and providing said carrier sheet on said substrate, such as this is the case, for example, with DPL (Direct Pressure Laminate) laminate panels.

2. Description of Related Art

Such panels are known as such, for example, from U.S. Pat. No. 1,971,067, U.S. Pat. No. 3,173,804, U.S. Pat. No. 3,554,827, U.S. Pat. No. 3,811,915, WO 01/48333, WO 01/47724, U.S. 2004/0026017, WO 2004/042168, EP 1 872 959 or DE 195 32 819 A1. From said documents, it is also known that said material layers can comprise one or more primer layers, wherein these primer layers extend substantially underneath said print, and can comprise one or more finishing layers, which extend substantially above said motif. Such finishing layers can comprise, for example, transparent or translucent synthetic material layers, which form a protective layer above the, whether or not printed, motif and can comprise, for example, wear-resistant particles, such as aluminum oxide. It is not excluded that this protective layer comprises a material sheet, such as a paper sheet, which, for example, is provided with a synthetic material, such as an amino resin.

From the aforementioned patent documents, various methods are known for providing the surface of a coated panel with a structure. From WO 2004/042168, it is known to provide recesses in the substrate itself or in a primer layer and to perform, on this structured substrate, a print in the form of a motif. From WO 01/47725, U.S. Pat. No. 3,811,915 and U.S. Pat. No. 3,554,827, it is known to provide a lacquer-repellent agent on the printed motif, such that the lacquer layer subsequently provided there above will harden selectively, such that a structure is formed on the final panel. From WO 01/48333, it is known to provide, in a lacquer layer provided above the motif, impressions by means of a die or a pressing cylinder. From WO 01/47724, it is known to selectively provide a transparent lacquer layer above a motif by means of an inkjet and thereby realize a structure, wherein the thus provided lacquer layer covers the motif only partially and a portion of the motif thus is unprotected against wear.

In respect to flexibility and/or in respect to feasible structures, the above-mentioned techniques leave much to be desired. For example, it is difficult to realize by these techniques in a smooth manner structures corresponding to the motif provided by the print. Moreover, according to some of the known techniques, the motif remains partially unprotected against, for example, wear or moisture penetration.

SUMMARY

The present invention in the first place aims at offering an alternative method for manufacturing coated panels of the above-mentioned type, which, according to various preferred embodiments thereof, can be performed smoother and/or more economical than the methods from the state of the art and/or offers a solution for one or more disadvantages of the methods from the state of the art.

To this aim, the invention relates to a method for manufacturing coated panels of the type which comprises at least a substrate and a top layer, provided on this substrate, with a motif, wherein the method for realizing the top layer comprises at least two steps, namely, a first step in which a synthetic material layer is provided on the substrate, and a second step in which a relief is provided on the surface of said synthetic material layer, with the characteristic that said relief comprises a pattern of recesses and/or protrusions, wherein this pattern is at least partially determined by means of a light-projection technique. The use of a light-projection technique for realizing a relief in a synthetic material layer can lead to an exceptionally smooth, contact-free method for applying recesses and/or protrusions.

DESCRIPTION OF EXAMPLE, NON-LIMITING EMBODIMENTS

The method of the present invention can be realized in practice according to various possibilities. Below, three possibilities are described.

According to a first and principal possibility, the projected light has the aim of hardening portions of the aforementioned synthetic material layer, whereas unexposed portions of this synthetic material layer can be removed and thus form recesses between the hardened portions. According to a particular preferred embodiment, said synthetic material layer substantially consists of a UV-hardening material, such as UV lacquer, and the projected light comprises at least UV light, wherein this light then effects at least a partial hardening of certain portions of the UV-hardening material.

In connection with this first possibility, it is noted that said synthetic material layer preferably is hardened over at least 80 percent of its surface by means of the light-projection technique of the invention. According to this preferred embodiment, then only a small portion of not hardened synthetic material has to be removed, such that, spread over the synthetic material layer, this results in the generation of recesses. Such recesses can be applied, for example, for imitating wood pores. Preferably, the hardened part of the synthetic material layer, in the case that the method is applied for manufacturing floor panels, forms the walkable surface of the floor panel.

According to a second possibility, the projected light can be applied for realizing a structure on a press element, wherein this press element then in a further step is applied for structuring said synthetic material layer of the panel. The structure of the press element then preferably is formed by hardening, by means of the projected light, a substance on the surface of the press element. This substance initially preferably is provided evenly or approximately evenly on the surface of the press element and is hardened only locally, after which the not hardened parts are removed. The substance may relate, for example, a UV-hardening substance, after which the portions exposed to projected UV light form protrusions on the surface of the press element and these protrusions are applied for realizing recesses in the synthetic material layer of the panel. In such case, the synthetic material layer of the panel preferably relates to a synthetic resin, such as a melamine resin.

In connection with this second possibility, it is noted that said substance preferably is hardened over 20 percent of its surface or less by means of the light-projection technique of the invention.

According to a third possibility, the projected light can be applied for realizing a mask with transparent and non-transparent parts, wherein this mask then is applied for realizing the relief in the synthetic material layer of the panel. Preferably, the exposed parts of the mask form the non-transparent parts. To this aim, again use can be made of a UV-hardening substance and projected light comprising UV light. Said substance can be provided evenly or approximately evenly on the mask and can be hardened locally by means of the light-projection technique there, where a non-transparent part is desired. The not hardened parts then are removed, for example, by washing them off or removing them mechanically.

In connection with this third possibility, it is noted that said substance preferably is hardened over 20 percent of its surface or less by means of the light-projection technique of the invention.

According to a preferred embodiment of the invention, use is made of a digital light projection technique, preferably of a light-projection technique which as such makes use of a "Digital Micromirror Device" or DMD; this is a chip on which microscopically small minors are located. Each tiny mirror corresponds to a pixel of the projection. The light of a lamp beams on these tiny minors and the tiny mirrors turn over when the respective pixel has to be projected. Up to 2 millions or more of tiny mirrors can be situated on said chip. By means of such projection technique, a very nuanced relief can be obtained. For an example of a DMD projector, reference is made to U.S. Pat. No. 6,874,894. It is clear that, in the case that UV light has to be projected, the lamp of a DMD projector known as such can be replaced by one or more UV lamps or UV LEDs, and that the color filter or color wheel possibly present can be switched off or replaced by a filter which is transparent to UV light.

Preferably, according to the invention a light-projection technique is applied which projects an image, wherein this image preferably minimally shows a surface area of ten square centimeter, rather than a light-projection technique which comprises a moving light beam with which a surface can be scanned point by point, although this is not excluded. Preferably, the applied light-projection technique is able to project an image of minimum 0.2 square meters and still better of minimum 1.5 square meters. Preferably, such image can be projected with a resolution of at least 100 pixels per inch, or still better of at least 300 pixels per inch.

As aforementioned, the projected light preferably effects a local hardening reaction in said synthetic material layer, and/or the exposed part of this synthetic material layer remains present on the panel.

Preferably, said second step follows said first step. In the case of the also above-mentioned first possibility, said light-projection technique thus preferably is applied when the synthetic material layer or a portion thereof already has been provided on the substrate. However, it is not excluded that the respective synthetic material is exposed and/or provided with the relief prior to being provided on the substrate. In such case, said synthetic material preferably is applied as a film or as a synthetic material layer which is provided on a carrier sheet, such as a paper sheet.

Preferably, the aforementioned motif is obtained by performing a print on the aforementioned substrate. Herein, the substrate, prior to the print, already can be provided with one or more material layers forming, for example, a printing background. Preferably, for said print a digital printing technique is applied, such as inkjet printing. Preferably, UV-based inks are applied. Of course, it is not excluded that an analogous printing technique might be applied, such as offset printing or gravure printing, for example, by means of one or more printing cylinders. According to the invention, further it is, of course, not excluded that use is made of a motif which is printed on a flexible material sheet, such as on a paper sheet, which material sheet then is applied wholly or partially on the substrate.

Preferably, the data applied for printing the motif originate from the same basic data as the data applied for controlling the light-projection technique. The basic data can be obtained, for example, by optically and/or tangibly scanning-in of a natural product to be imitated, for example, by scanning-in wood or stone. Of course, after scanning these data can be processed by means of image processing programs. Preferably, at least the data for printing and/or projecting are stored in a digital format, such that these data can be applied for controlling a digital printing technique and/or a digital projection technique.

It is noted that the synthetic material layer which is provided with the relief preferably relates to a translucent or transparent synthetic material layer, which is situated above the motif and in this manner protects this motif at least to a certain extent against wear. In that case, it is possible that the synthetic material layer forms the surface of the final coated panel. However, it is also possible that further finishing layers are provided on the respective synthetic material layer, such as, for example, a UV-hardening, electron beam-hardening or other lacquer layer, which preferably comprises hard particles, such as ceramic particles having an average particle size of less than 200 micrometers.

Preferably, the aforementioned synthetic material layer extends substantially over the entire surface of the substrate. In this manner, a relief or structure can be obtained over the entire surface of the substrate. Preferably, also in the finally formed coated panel said synthetic material layer extends over substantially the entire surface of the substrate. Thus, preferably material of this synthetic material layer also remains present in the deeper structural parts of the top layer. In this manner, a good protection for the motif can be obtained. To this aim, the motif can be provided, for example, with at least two similar synthetic material layers, wherein the synthetic material layer situated closest to the motif is hardened over the entire or approximately entire surface of the panel, whereas the synthetic material layer situated farthest from the motif is subjected to said light-projection technique for obtaining a local, selective hardening.

Clearly, it is not excluded that the synthetic material layer, instead of being situated above the motif, is situated there underneath or is formed by the motif or a portion thereof, in which case it does not necessarily have to be translucent or transparent. Thus, according to the invention it is not excluded that the synthetic material layer, which is provided with the relief, should relate to a material layer which is situated underneath the motif and, for example, forms part of said printing background.

Preferably, the finally obtained coated panels show a relief at their surface, said relief comprising at least parts obtained by means of the technique of the invention, even when the structured synthetic material layer should be located underneath the motif.

Preferably, the relief is obtained only after the respective part of the synthetic material layer already has been provided on the substrate. Hereby, for the application of the synthetic material layer, techniques may be chosen which are suitable for covering flat substrates, which considerably simplifies such method and restricts or even excludes the risk that undesired inclusions, such as air inclusions, are formed in the synthetic material layer.

Due to the fact that the pattern of the relief is at least partially determined by means of a light-projection technique, a relief corresponding to the motif can be provided simpler, smoother and more flexible. For example, a digital technique can be applied both for forming the motif and for forming said recesses and/or protrusions, such that possibly a similar resolution can be obtained in the motif and in the respective part of the relief. Moreover, by means of such projection technique, a smooth change of structures can be performed, which results in a flexible method.

For removing the not exposed parts, as a material-removing technique, for example, a chemical etching technique can be applied, which locally acts on the synthetic material layer, or a mechanical erosion technique, such as sandblasting or shotpeening. Further possibilities therefor are rinsing off, brushing and/or the use of an ultrasound treatment.

Preferably, the method is applied for manufacturing coated panels, whereof said substrate comprises a wood-based material, such as MDF or HDF. Such material can be smoothly provided with an evenly sanded upper surface, such that possible unevennesses of the respective upper surface do not interfere with the structure or relief realized on the upper surface. In order to avoid such interfering with the structure, use can also be made of primer layers comprising a filler, with which possible unevennesses on the upper surface of the substrate then can be filled.

It is clear that the steps set forth in the introduction can be performed on larger boards, of which then the final coated panels are formed, for example, by subdividing these larger boards with a sawing machine, as well as on panels which already approximately show the dimensions of the final coated panels. In order to react smoothly to an order and in order to exclude unnecessary stocks, it is advantageous to realize the structure and/or the motif as late as possible in the manufacturing process. In such case, they are preferably provided directly on panels showing approximately or entirely the dimensions of the final coated panels. In the same case, the respective panels may also already be provided with possible edge finishings, such as milled coupling means or other profiled edge parts. Of course, it is not excluded that such profiled edge parts are provided later during manufacture. The application of structure or relief panel by panel has the advantage that the risk of this structure disappearing, for example, in that it is milled away or sawn away or is removed in another manner, is considerably reduced, even when this relates, for example, to relatively limited structures located on the edge of the panel, such as chamfers having a depth of less than 1 millimeter.

Preferably, the position of the relief or the structure, according to the invention, is referred to a final edge or a final corner point of the coated panel, whether this edge now already has been obtained or still has to be obtained. This preferred embodiment can be performed in the most simple manner when the substrates already have the respective final edge or corner point; however, it is not excluded that, even when the substrates do not yet show this final edge or corner point, still are aligned in respect to the edge or corner point still to be formed, for example, in that other reference means are provided, which take a position referring to the respective final edge or corner point. The present preferred embodiment, for example, allows obtaining in a smooth manner symmetrical structures, such as tile imitations or floor part imitations with two- or four-sided lower edge, wherein then preferably the width of the lower edges on opposite sides of the coated panels is made equal or approximately equal.

Further, it is clear that according to the invention, preferably a structure is obtained which corresponds to the aforementioned motif. In the case of a wood motif and a wood structure, whether or not corresponding, said recesses preferably at least relate to imitations of wood pores.

Generally, it is noted that the relief mentioned in the invention can also be limited in depth, such that it in reality relates to a pattern of different gloss degrees. Further, it is also noted that the relief preferably is tangibly present at the surface of the final coated panel. However, according to certain embodiments, it is not excluded that the respective relief is internally present in the top layer of the coated panel and is not tangibly, but still visibly present on the surface of the coated panel. Such embodiment can be obtained when, by means of the technique of the invention, a relief is imparted to the motif itself, whereas the surface of the coated panel as such is made substantially or completely flat. With such relief, depth effects can be obtained which remain visible on the surface of the coated panel. Other visible effects, which are not tangibly present on the surface of the coated panel, are not excluded.

The light-projection technique preferably covers the surface of the panel, press element or mask, in a single turn, according to the above-mentioned possibilities, which corresponds to the total surface thereof to be exposed. However, it is not excluded that a plurality of exposures are applied, which each treat a partial surface, either by sequentially exposing different partial surfaces at least with the same projector, or by simultaneously exposing different partial surfaces at least with a plurality of projectors, or by applying both techniques. Preferably, the exposure of a partial surface takes place without a relative displacement between the surface to be exposed and the projector.

It is noted that the light-projection technique applied according to the invention does not necessarily have to cover a surface area, but can also be effective, for example, on a line.

As aforementioned, devices or principles known as such can be applied for the light projection. Further examples and possibilities therefor are, for example, the exposure techniques known as such from the patent documents U.S. 2002/135,857, U.S. 2002/085,133, EP 1 746 823 and U.S. 2006/066,924. The techniques presented in these patent documents relate to digital techniques, by which exposure can be performed by means of a matrix of light dots. In the first-mentioned documents, to this aim a so-called "light valve" is applied, which allows individually controlling a large number of light dots of a matrix. This may relate, for example, to the already above-mentioned DMD. Such technology already is applied as such with flatscreens. In the last-mentioned document, to this aim an exposure head is applied, which comprises a matrix of glass fiber ends by which each time a dot on a photosensitive material can be exposed. Each glass fiber can transport the light generated by one or more LEDs. Such exposure head can be applied for exposing photographic material in an analogous manner as a print head for printing a substrate and, in other words, can move relative in respect to the substrate to be exposed or can be made sufficiently large, such that one or more of these exposure heads, even standing still in respect to the substrate, still can expose the entire or approximately the entire width and/or length of the substrate. It is self-evident that the light source in each of these projectors or exposure techniques possibly must be replaced by a light source which radiates the light frequencies necessary for the respective embodiment of the invention, such as, for example, by one or more UV lamps or UV LEDs.

It is clear that the invention also relates to panels which are obtained directly by means of a method with the characteristics of the invention. Preferably, this herein relates to floor panels.

It is important to note that according to the invention, preferably relatively rigid panels are manufactured and no rollable coverings. Rigid panels have the advantage that they can easily be provided with connecting means, for example, screws, dowels or mechanical coupling means allowing that two of such panels, for example, floor panels, can be coupled to each other, for example, by milling the profiles of such coupling means into said substrate. Such coupling means and milling techniques are known as such from WO 97/47834 or DE 20 2008 008 597 U1. Due to their rigidity and the presence of coupling means, the manufactured coated panels are simple to install and do not require any gluing onto the underlying surface.

The present invention is in no way limited to the embodiments described herein above; on the contrary, such methods and panels can be realized according to various embodiments, without leaving the scope of the present invention.

What is claimed is:

1. A method for manufacturing coated panels of the type including at least a substrate and a top layer with a motif, the top layer provided on the substrate, the method comprising:

providing a synthetic material layer on the substrate;

providing a relief on the surface of the synthetic material layer;

wherein the relief shows a pattern of at least one of recesses and protrusions;

wherein the pattern is at least partially determined by using a light-projection technique;

wherein the synthetic material layer is a transparent or translucent material layer provided above the motif; and wherein the synthetic material layer includes at least a lower synthetic material layer situated closest to the motif that is hardened over essentially the entire surface of the panel, and an upper synthetic material layer situated farthest from the motif that is subjected to the light-projection technique to obtain local, selective hardening over at least 80% of the surface of the upper synthetic material layer; and using a mechanical erosion technique to remove parts of the surface of the upper synthetic material layer that are not exposed to the light-projection technique to form the recesses, such that the lower synthetic material layer exists below the recesses.

2. The method of claim 1, wherein the light-projection technique is a digital light-projection technique.

3. The method of claim 1, wherein the synthetic material layer includes a UV-hardening synthetic material layer; and wherein the light-projection technique involves emitting UV light.

4. The method of claim 1, wherein the light-projection technique makes use of a digital micromirror device.

5. The method of claim 1, wherein the synthetic material layer is provided on the substrate before the relief is provided on the surface of the synthetic material layer; and wherein the light-projection technique is applied while the synthetic material layer is on the substrate.

6. The method of claim 1, wherein the motif is obtained by performing a print on the substrate.

7. The method of claim 6, wherein the print is performed using a digital printing technique.

8. The method of claim 7, wherein data applied for printing originate from the same basic data as data applied for controlling the light-projection technique.

9. The method of claim 1, wherein the mechanical erosion technique comprises a brushing operation.

* * * * *